US006663101B2

(12) United States Patent
Barrand

(10) Patent No.: US 6,663,101 B2
(45) Date of Patent: Dec. 16, 2003

(54) PRINTER TO DOWNSTREAM PROCESSOR SHEET FEEDER

(75) Inventor: Phillip Neil Barrand, Mount Waverley (AU)

(73) Assignee: Placard Pty Ltd, Bayswater (AU)

( * ) Notice: Subject to any disclaimer, the term of this patent is extended or adjusted under 35 U.S.C. 154(b) by 14 days.

(21) Appl. No.: 09/792,433

(22) Filed: Feb. 23, 2001

(65) Prior Publication Data

US 2002/0079643 A1 Jun. 27, 2002

(30) Foreign Application Priority Data

Dec. 22, 2000 (AU) ..... PR2294/00

(51) Int. Cl.[7] ..... B65G 47/26; B65H 29/00

(52) U.S. Cl. ..... 271/184; 271/225; 198/457.03; 198/464.3

(58) Field of Search ..... 271/225, 184; 198/457.03, 464.3

(56) References Cited

U.S. PATENT DOCUMENTS 4,509,732 A * 4/1985 Kanno et al. ..... 198/457.03
4,724,945 A * 2/1988 Martin ..... 198/412
4,842,125 A * 6/1989 Besemann ..... 198/457.03
5,374,052 A * 12/1994 Folsom ..... 198/457.05
5,449,165 A * 9/1995 Naramore ..... 271/184
6,105,955 A * 8/2000 Rawlings et al. ..... 198/457.02
6,378,861 B1 * 4/2002 Middelberg et al. ..... 270/52.09

FOREIGN PATENT DOCUMENTS

JP 60-262735 A 12/1985

* cited by examiner

*Primary Examiner*—Donald P. Walsh
*Assistant Examiner*—Jonathan R. Miller
(74) *Attorney, Agent, or Firm*—Knobbe, Martens, Olson & Bear, LLP

(57) ABSTRACT

A sheet processing system comprises a high speed printer operative to print sheets fed through the printer longer edge first, and a downstream processor for performing a subsequent operation using the printed sheet fed shorter edge first. A sheet feeder for feeding the sheet to the downstream processor with its shorter edge first, comprises a sheet feed conveyor extending to said downstream processor, and input feed means for feeding the sheet from the printer laterally onto the sheet conveyor so that the longer edges of the sheet extend in a longitudinal direction of the sheet feed conveyor. Guide surfaces ensure alignment of the longer edges of the sheet in the longitudinal direction of the sheet feed conveyor during feeding to the downstream processor.

4 Claims, 2 Drawing Sheets

PRINTER TO DOWNSTREAM PROCESSOR SHEET FEEDER

BACKGROUND TO THE INVENTION

1. Field of the Invention

This invention relates to a sheet feeder, and more particularly to a sheet feeder for feeding sheets of paper from a printer to a downstream processor.

2. Description of the Prior Art

Certain processing machines for processing sheets, such as those for affixing credit/debit cards to sheets of paper, require A4 sheets of paper to be fed shorter-edge-first from a printer to the processing machine. These processing machines typically run at high speed, high volume, and require a suitably high speed, high volume, printer.

However, most high speed, high volume, printers feed sheets longer-edge-first as this enables the printer to operate more quickly owing to the shorter edge of the page being quicker to feed through the printer than the longer edge. Accordingly, there are few high speed, high volume, printers available which feed sheets of paper shorter-edge-first, and those that are available are typically much more expensive than their longer-edge-first counterparts. Attempts to solve this problem have been made, one such attempt taking the approach of modifying software in the printer to enable the printer to feed shorter-edge-first, but this has not led to a satisfactory solution, and industry is still faced with the necessity of using the expensive high speed, high volume, shorter-edge-first printers.

SUMMARY OF THE INVENTION

In accordance with the present invention, there is provided a sheet feeder for feeding a sheet from a printer to a downstream processor, said feeder serving to receive the sheet from the printer in a first direction and comprising first feed means for feeding the sheet to the downstream processor in a second direction, and alignment means for aligning the sheet in the second direction.

Preferably, the sheet is rectangular with a longer edge and a shorter edge, the sheet is received from the printer longer-edge-first in the first direction, and is fed from the feeder to the downstream processor shorter-edge-first in the second direction, the second direction being substantially perpendicular to the first direction.

Preferably, the first feed means is an endless belt and the alignment means includes a guide surface, and the sheet feeder further includes second feed means for moving the sheet longer-edge-first to a position in which the leading longer edge of the sheet abuts the guide surface.

Preferably, the alignment means further includes a rail having a substantially vertical portion opposite the guide surface and a substantially horizontal portion, the rail being mounted substantially parallel to the belt in a raised position relative to the belt such that, during shorter-edge-first movement of the sheet, a trailing longer edge of the sheet adjacent the rail is curled upwardly to prevent or at least alleviate longitudinal buckling of the sheet.

Further according to the invention, there is provided in a sheet processing system comprising a printer operative to print sheets fed through the printer in a direction transverse to the longitudinal axis of the sheet whereby the sheet is fed through the printer longer edge first, and a downstream processor for performing a subsequent operation using the printed sheet, the improvement comprising a sheet feeder for feeding the sheet to the downstream processor with a shorter edge first, said feeder comprising a sheet feed conveyor extending to said downstream processor, input feed means for feeding the sheet from the printer laterally onto the sheet conveyor so that the longer edges of the sheet extend in a longitudinal direction of the sheet feed conveyor, and means for ensuring alignment of the longer edges of the sheet in the longitudinal direction of the sheet feed conveyor during feeding to the downstream processor.

BRIEF DESCRIPTION OF THE DRAWINGS

The preferred embodiment of the invention will now be described, by way of example only, with reference to the accompanying drawing, in which.

DESCRIPTION OF THE PREFERRED EMBODIMENT

Figure 1:
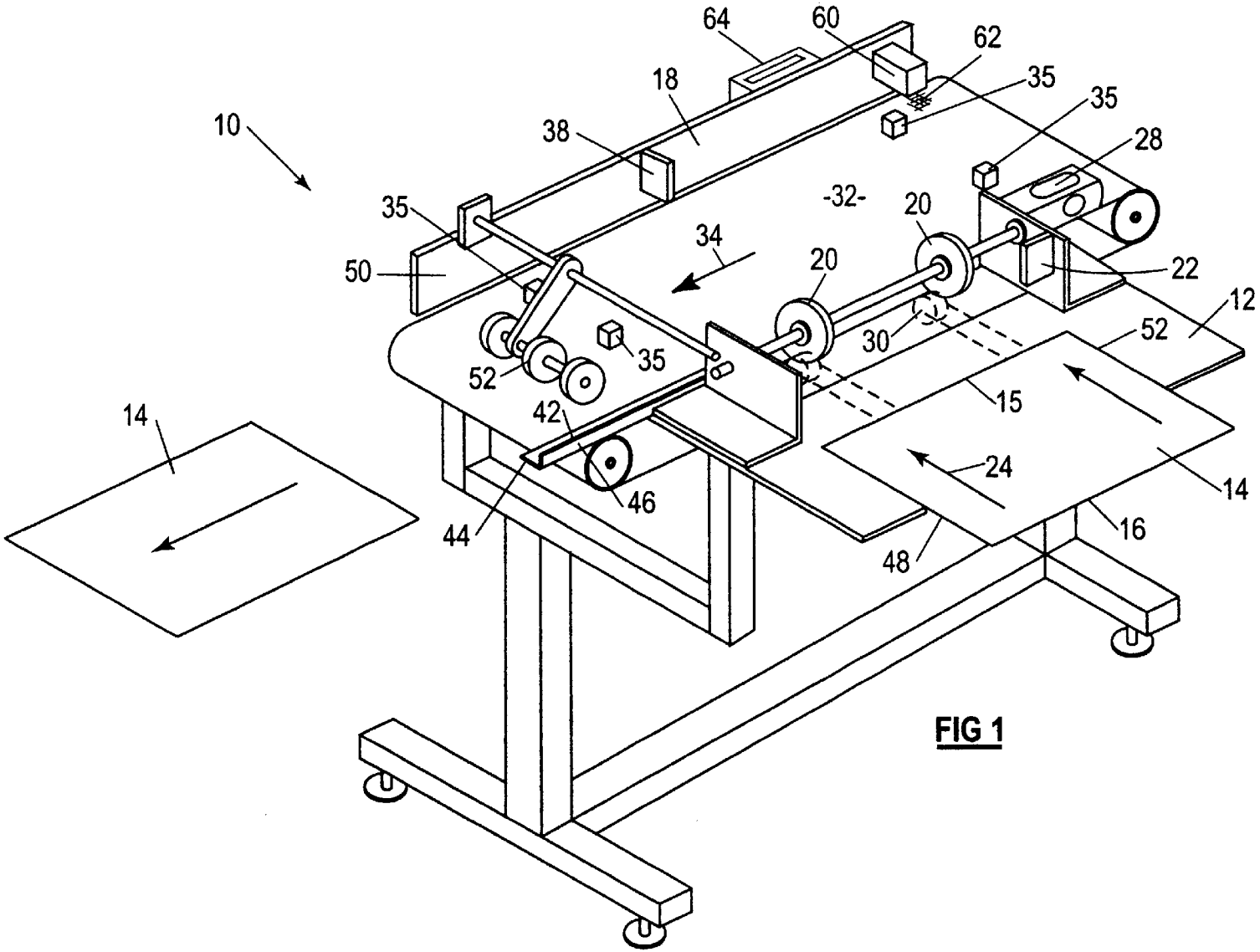
FIG. 1 is a perspective view of a preferred embodiment of a paper feeder according to the present invention.
Figure 2:
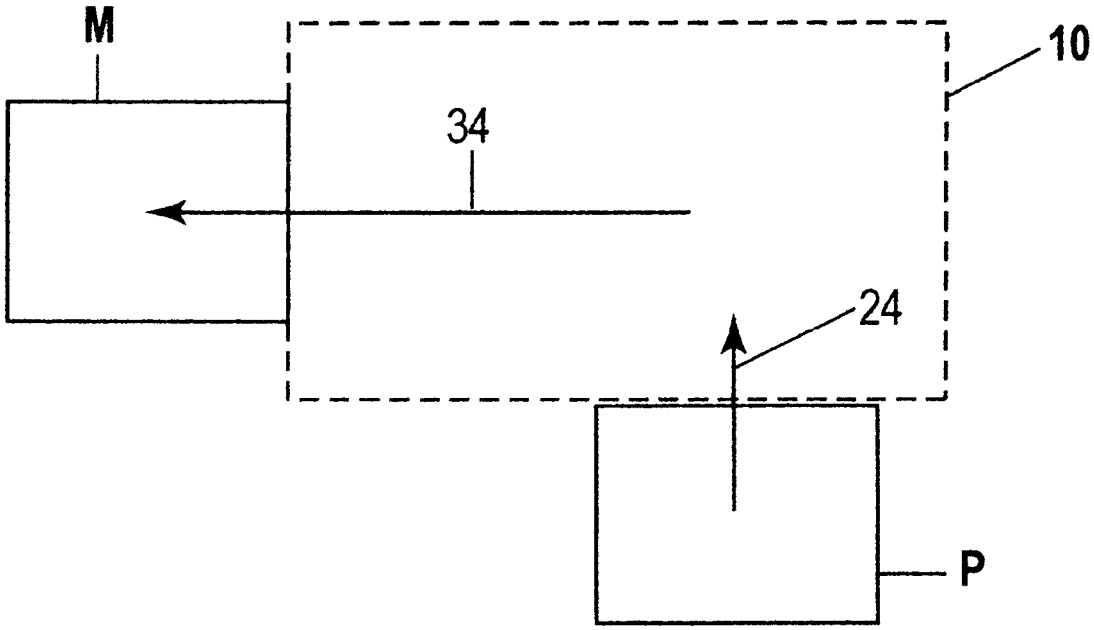
FIG. 2 shows schematically the manner in which the feeder is incorporated in a processing system including a printer and a downstream processor.

The paper feeder 10 in accordance with the preferred embodiment of the invention includes a receiving means in the form of a receiving tray 12 for receiving a sheet 14 of paper from a printer P. In the particular embodiment shown, the sheet feeder 10 is configured to operate with sheets of A4 paper, however it should be noted that other embodiments of the sheet feeder may be configured to operate with sheets of other sizes and materials. The sheet feeder 10 is placed adjacent the printer P such that the longer edges 15, 16 of the A4 sheets 14 leaving the printer P are substantially parallel to a guide surface 18 of an alignment system of the sheet feeder 10 and such that the sheet 14 can be propelled (for example by means of the printer or gravity) to engage with at least one motor-driven roller 20 and to be sensed by a first sheet sensor 22. In the embodiment shown, there are provided two spaced motor-driven rollers 20 which assist in keeping the longer edges 15,16 of the sheet 14 substantially parallel with the guide surface 18 throughout the longer-edge-first movement of the sheet 14 from the printer P. The first sheet sensor 22 is a photo cell of the infra-red type, having a beam-emitting portion mounted above the tray 12 and a beam-receiving portion mounted below the tray 12. When a sheet 14 is detected by the first sheet sensor 22, the motor-driven rollers 20 are operated to drive the sheet 14 in a first direction (indicated by arrows 24) toward the guide surface 18. A delay may be incorporated into the control system of the motor-driven rollers 20 to operate the rollers 20 for a short period of time after the sheet 14 has travelled past the first sheet sensor 22. This delay ensures that the leading longer edge 15 of the sheet 14 will reach the guide surface 18. The applicant has also determined that it would be possible for the motor-driven rollers 20 to run continuously, however this would consume power unnecessarily and would result in excessive wear of the motor 28. Each of the motor-driven rollers 20 is associated with a corresponding sprung roller 30 mounted beneath the motor-driven roller 20 for ensuring contact between the sheet 14 and the motor-driven roller 20 and thereby ensuring reliable operation.

Reliable operation of the sheet feeder 10 is particularly important when the sheet feeder 10 is used in conjunction with a downstream processing machine M for applying credit/debit cards to sheets of paper as the sheets being received by the printer may be unique, and may thus have a corresponding credit/debit card awaiting to be applied to the sheet in the downstream processing machine. Accordingly, if a unique sheet is not reliably handled by the sheet feeder 10, for example if proper engagement between the motor 15 driven rollers 20 and the sheet 14 is not achieved, the sheet 14 may be moved in a skewed manner and may be damaged rendering it unusable, and the sequence of the downstream processing may be upset.

The sheet 14 is propelled by the motor-driven rollers 20 across a main feed belt 32, such that the leading longer edge 15 of the sheet 14 abuts the guide surface 18. The belt 32 is endless and moves in a second direction (indicated by arrow 34) which is substantially perpendicular to the first direction 24, the belt 32 having a downstream end positioned to discharge the sheet 14 to the intake zone of the downstream processor M. The belt 32 is of a material which allows the sheet 14 fed by the rollers 20 to slide freely across the surface of the belt. By way of example, the belt 32 can be formed of polyurethane. The belt 32 is formed with sets of lateral flights 35 spaced lengthwise along the belt by a distance greater than the length dimension of the sheet 14 so that movement of the sheet 14 by the belt 32 occurs by engagement of a set of flights 35 with the trailing end of the sheet 14.

In operation, just prior to the leading longer edge 15 of the sheet 14 abutting the guide surface 18, the sheet 14 is detected by a second sheet sensor 38 which, as with the first sheet sensor 22, is preferably of infra-red type. When a sheet is detected by the second sheet sensor 38, after a short delay which allows the sheet to settle against the guide surface 18 (as there may be some 'bounce' of the sheet 14 off the guide surface 18), the main feed belt 32 is operated to feed the sheet 14 in the direction of arrows 34 by engagement with its adjacent set of flights 35 with the trailing edge of the sheet.

In the embodiment illustrated, the alignment system for ensuring alignment of the sheet 14 in the direction of travel 34 of the belt 32 includes the guide surface 18 and other guide surfaces as will be described. The guide surface 18 consists of a substantially vertical wall against which the leading longer edge 15 of the sheet 14 abuts, and which is made of a suitably smooth material such as stainless steel which allows the sheet 14 to slide along the guide surface 18 when being moved in the second direction 34. The alignment system also includes an L-shaped rail 42, for example of aluminium, mounted opposite a downstream portion of the guide surface 18, the L-shaped rail 42 having a substantially horizontal portion 44 and a substantially vertical portion 46. The guide surface 18 and the L-shaped rail 42 are mounted apart by a distance only marginally greater than the length of the shorter edge 48 of the sheet 14, as this assists alignment of the sheet 14 and prevents jamming. The rail 42 is mounted in a position slightly above the level of the belt 32 so that when the sheet 14 rests between the guide surface 18 and the vertical portion 46 of the rail 42, the opposite longer edge 16 of the sheet 14 adjacent the vertical portion 46 of the rail 42 rests on the substantially horizontal portion 44 of the rail 42 and is curled upwardly thus giving the sheet 14 increased longitudinal rigidity to reduce buckling of the sheet 14 during its movement in the second direction 34, curling of the sheet 14 being ensured by gravity rollers 52 pivotally mounted above the belt 32 adjacent the downstream end thereof, and exerting pressure against the upper surface of the sheet 14 under their own weight to ensure contact between the belt 32 and the sheet 14. If necessary, a further set of gravity rollers can be mounted upstream of the rollers 52 to ensure that contact is maintained between the sheet 14 and the belt.

When the sheet 14 reaches the downstream end of the belt 32 and is discharged onto the upstream end of the downstream processor M, for example onto an intake conveyor belt or onto intake conveyor rollers of the processor, the belt 32 is stopped in a position in which the next set of conveyor flights 35 is positioned to engage the trailing edge of the subsequent sheet 14 fed from the printer P. In the embodiment shown this is achieved by a sensor 60, preferably an infra-red sensor, which senses a reflective zone 62 on the belt 32 adjacent each set of flights 35. Alternatively, stopping of the belt 32 in a position to receive the subsequent sheet 14 can be effected by other means such as sensing the position of the sheet 14 already at the downstream end of the belt 32.

To ensure correct synchronism of operation of the printer P with the operation of the downstream processor M, the printer P operates "on demand" according to the operation of the downstream processor M. The control system between the downstream processor M and the printer P to achieve this will be well known per se to persons skilled in the art and does not form part of the present invention. However in determining the speed and operative length of the belt 32, account must be taken of the likely maximum output of the printer P (in terms of sheets per unit time) to ensure that successive sheets are not in interfering relationship on the belt 32. By way of example, the printer P may have a maximum output of 40 sheets per minute with the feeder 10 being designed to cope with that feed rate although, in practice, as the printer P operates "on demand" in accordance with the requirements of the downstream processor M it is likely to operate at an average output somewhat less than that figure.

Although the downstream processor M discussed above is a machine for applying credit/debit cards to sheets of paper, the present invention is equally useful in conjunction with other processing machinery requiring shorter-edge-first in-feed, for example, machines for applying other types of cards to sheets, and paper folding machines.

The sheet feeder 10 is also provided with a counter 64 activated by the second sheet sensor 38, to count the number of sheets passing through the sheet feeder.

A prototype of the sheet feeder has been tested and is capable of feeding A4 sheets at a rate greater than is provided by a typical longer-edge-first high speed, high volume, printer. The speed of the sheet feeder may be increased by increasing the speed of the belt 32 and/or the speed of the motor-driven rollers 20.

The present invention provides an inexpensive alternative to shorter-edge-first high speed, high volume, printers. It also provides those requiring shorter-edge-first in-feed to a downstream processor with a much greater choice of printers. The sheet feeder delivers paper with improved alignment, and as the paper is fed through a right-angle change in direction, the printer is located to the side of the sheet feeder rather than being in-line with the downstream processor resulting in a more convenient usage of space.

The applicant has foreseen that the present invention would be useful not only in applications requiring the re-orientation of rectangular paper for the sake of shorter-edge-first feeding, but also to those applications requiring the re-orientation of sheets in general, as the sheet may have to be re-oriented for some reason unrelated to the shape of the sheet. For example, the sheet may have to be re-oriented owing to the orientation of an image on the sheet or perhaps some orientation-dependent property of the sheet.

The embodiment has been described by way of example only and modifications are possible within the scope of the invention. In particular, it should be noted that other suitable types of sensors may be used in place of the infra-red photo cell sensors, and instead feeding the sheet by flights on the belt, the belt may act in conjunction with one or more rollers which maintain the sheet in driving contact with the belt to ensure reliability of feed, or alternatively the belt may be associated with a suction system which maintains the sheet in driving contact with the belt.

What is claimed is:

1. A sheet feeder for feeding a sheet from a printer to a downstream processor, said feeder serving to receive the sheet from the printer in a first direction and comprising first feed means for feeding the sheet to the downstream processor in a second direction, and alignment means for aligning the sheet in the second direction, wherein the sheet is rectangular with a longer edge and shorter edge, and the sheet is received from the printer longer-edge-first in the first direction, and is fed from the feeder to the downstream processor shorter-edge-first in the second direction, the second direction being substantially perpendicular to the first direction and wherein the alignment means includes a guide surface extending in the second direction and the sheet feeder further includes second feed means for feeding the sheet from the printer longer-edge-first to a position in which the leading longer edge of the sheet abuts the guide surface for subsequent feeding by the first feed means and wherein the first feed means comprises a belt which receives and supports the sheet received from the second feed means wherein the belt is intermittently driven, and said feeder further comprising a sensor for sensing the presence of a belt in said position in which its leading longer edge abuts the guide surface, said sensor initiating drive of the belt to feed the sheet in said second direction and further comprising sensor means for stopping the belt in a condition to receive a further said sheet from the printer upon delivery of the previous sheet to the downstream processor and wherein the belt includes flights for engaging trailing edges of the sheets and wherein the sensor means is responsive to the position of the belt and the flights thereon relative to the second feed means.

2. A sheet feeder according to claim 1, wherein the alignment means further includes a rail having a substantially vertical portion opposite the guide surface for co-operation with the opposite longer edge of the sheet, said rail having a substantially horizontal portion mounted substantially parallel to the belt and in a raised position relative to the belt such that during movement of the sheet by the belt, the said opposite longer edge of the sheet adjacent the rail is curled upwardly to reinforce the sheet against longitudinal buckling.

3. A sheet feeder according to claim 1, wherein the sensor means is responsive to the position of the sheet at the downstream end of the belt.

4. A sheet feeder for feeding a sheet from a printer to a downstream processor, said feeder serving to receive the sheet from the printer in a first direction and comprising first feed means for feeding the sheet to the downstream processor in a second direction, and alignment means for aligning the sheet in the second direction, wherein the sheet is rectangular with a longer edge and a shorter edge, and wherein the sheet is received from the printer longer-edge-first in the first direction, and is fed from the feeder to the downstream processor shorter-edge-first in the second direction, the second direction being substantially perpendicular to the first direction wherein the alignment means includes a guide surface extending in the second direction and wherein the sheet feeder further includes second feed means for feeding the sheet from the printer longer-edge-first to a position in which the leading longer edge of the sheet abuts the guide surface for subsequent feeding by the first feed means and wherein the first feed means comprises a belt which receives and supports the sheet received from the second feed means, the belt being intermittently driven, said feeder further comprising a first sensor for sensing the presence of a sheet on the belt in said position in which its leading longer edge abuts the guide surface, said first sensor initiating drive of the belt to feed the sheet in said second direction, and a second sensor for stopping the belt in a condition to receive a further said sheet from the printer upon delivery of the previous sheet to the downstream processor and wherein the belt includes flights for engaging trailing edges of the sheets and the second sensor is responsive to the position of the sheet at the downstream end of the belt.

* * * * *